US008844928B2

(12) United States Patent
Simon

(10) Patent No.: US 8,844,928 B2
(45) Date of Patent: Sep. 30, 2014

(54) DUAL-PROFILE FOOSBALL FOOT

(76) Inventor: Steven Mark Simon, Austin, TX (US)

( * ) Notice: Subject to any disclaimer, the term of this patent is extended or adjusted under 35 U.S.C. 154(b) by 186 days.

(21) Appl. No.: 13/484,247

(22) Filed: May 30, 2012

(65) Prior Publication Data

US 2013/0320617 A1 Dec. 5, 2013

(51) Int. Cl.
*A63B 67/04* (2006.01)
*A63F 7/07* (2006.01)

(52) U.S. Cl.
USPC ..... 273/108.52; 273/108.54

(58) Field of Classification Search
CPC ..... A63F 7/06; A63F 7/0616; A63F 7/07
USPC ..... 273/108.1, 108.52, 108.54, 108, 273/129 R–129 W; D21/386
See application file for complete search history.

(56) References Cited

U.S. PATENT DOCUMENTS

| | | | | | |
|---|---|---|---|---|---|
| 3,920,244 | A * | 11/1975 | Kaiser | ..... | 273/108.52 |
| 4,046,378 | A * | 9/1977 | Furr | ..... | 273/108.52 |
| 5,137,276 | A * | 8/1992 | Monneret | ..... | 273/108.52 |
| 5,333,864 | A * | 8/1994 | McCloud | ..... | 273/108.52 |
| 6,231,046 | B1 * | 5/2001 | Tien | ..... | 273/108.52 |
| 6,325,372 | B1 * | 12/2001 | Chen | ..... | 273/108.1 |
| D557,350 | S * | 12/2007 | Jackson | ..... | D21/386 |

* cited by examiner

*Primary Examiner* — Sebastiano Passaniti
(74) *Attorney, Agent, or Firm* — Jeffrey M Hersh

(57) ABSTRACT

A foot for a foosball man having a convex center portion along the operative region of the front surface of the foosball foot, and substantially straight edges, or flat planes, along the outer portions. This dual-configuration enables the foot to take advantage of the greater control in trapping, controlling and hitting the ball forward using the convex portion, and the improved control of hitting angled and bank shots using the straight edge, or flat plane, outer portions.

19 Claims, 8 Drawing Sheets

DUAL-PROFILE FOOSBALL FOOT

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This invention relates generally to the field of foosball, and more particularly to a foosball foot having a convex profile in the center region of the front side of the foot, and a generally straight profile on the end regions of the front side of the foot.

2. Background Art

There are two basic shapes for the front face of the foot of a foosball man—a convex profile and a generally straight profile. Each has its advantages and disadvantages in trapping, controlling, passing, angling, and shooting the ball.

The convex shape offers the player greater control in handling the ball to trap and control it, and to pass or shoot the ball straight forward. The convex profile of the foot portion of the man allows a great range of rotational angles in which the foot can press the ball into the play field and hold it in place. It also provides a greater range in the rotational direction at which the foot may slightly hit the ball to propel it forward.

The convex profile is poor, however, when hitting the ball on the edge of the man when shooting the ball at an angle, including a bank shot off the side wall. The reason for this lack of control is that at different relative angular positions at which the foot hits the ball, the angle that the ball is propelled varies, leaving a very small range of accuracy. This problem is exacerbated by the convex shape causing unpredictable spin on the ball, which affects its trajectory. In addition to hampering a player from hitting an angled shot with accuracy—such as from the side of the table to the center of the goal—the small range of accuracy makes it particularly difficult to hit a bank shot, risking missing the goal or more often being blocked by a defender.

An example of a convex-shaped foot is described in McCloud, U.S. Pat. No. 5,333,864, issued Aug. 2, 1994. McCloud shows a generally flat plane across the top portion of the forward face of the foot, and a convex shape or profile towards the lower portion. This presents a problem where some rotational positions uses the convex portion, and others use the straight portion, providing poor and inconsistent control for both straight and angled shots. As explained above, the convex outer portion of the foot makes hitting angled shots inconsistent and difficult to control.

The relatively straight profile of the foot avoids the problem the convex profile has in hitting angled and bank shots because the straight edge provides a more consistent angle of impact with the ball at different positions along the impact range of the foot in the rotational dimension. It also maintains a consistent side spin on the ball. This improves control in hitting an angled or bank shot that passes around or between the defender's men and into the goal. However, the straight edge provides far less control in holding the ball in place and hitting and passing the ball forward than the convex profile. Because the straight foot profile has a much smaller rotational range than the convex profile, it has less controllable surface area and does not allow the control that a convex surface allows.

An example of the straight-edge design is shown in Furr, U.S. Pat. No. 4,046,378, issued Sep. 6, 1977. As shown in FIG. 1 of Furr, to achieve a near vertical force vector from the foot through the ball onto the playfield, the foosball man needs to be positioned at an angle closer to parallel to the playfield than perpendicular. While not shown directly in the drawings, it is clear that if the foosball man is closer to perpendicular, the force vector is directed more forward, that is, in the horizontal axis, pushing the ball away from the foot instead of trapping and controlling the ball. There is a relatively small range of angles that permit control of the ball, leaving a small margin of error in trapping, controlling the ball, and passing.

Various designs can adjust the convex profile to be less radiused, thereby trying to allow more control for angled and bank shots at the expense of less control of controlling, hitting, and passing the ball. Compromises can be made in this fashion, but the best that can be achieved is mediocre control of angled and bank shots, loss of some control of straight shots, and inconsistent passing.

Accordingly, it would be advantageous to design a foot profile that incorporates the advantages of each of the convex and straight profile of the foosball foot.

BRIEF SUMMARY OF THE INVENTION

The present invention solves this problem by providing a convex shape in the center region of the foosball foot, and a straight profile at the outer edges of the foot. The convex profile in the center region provides good control for holding the ball in place, hitting the ball forward, and passing the ball laterally. The straight outer edge profile, however, enables the player to hit an angled or bank shot with greater accuracy and with controllable spin. Thus, there are two different planes of contact surfaces on the front side of the foosball foot.

In the preferred embodiment, as one moves laterally from the centerline of the forward face of the foosball foot, the convex profile is abruptly changed from the convex to the straight profile. An orthogonal ledge, or step, separates the three regions, that is, the convex center region and the two straight outer regions on each side (or end).

In the preferred embodiment of the invention, the foot is 0.875 inches in width, and the convex portion in the center extends 0.25 inches to either side of the centerline, or 0.5 inches in width. Each of the two outer flat portions of the foot are 0.1875 inches in width.

In an alternate embodiment of the present invention, the convex surface is not curved but substantially flat, defining a plane similar to the outer portion's straight profile. However, the plane defined by the center region plane is not the same as the plane defined by the outer portion. The two planes may be parallel and offset by a fraction of an inch, or they may be angled differently.

BRIEF DESCRIPTION OF THE SEVERAL VIEWS OF THE DRAWINGS

The accompanying drawings illustrate the invention, where like reference numerals indicate the same feature throughout the drawings.

DETAILED DESCRIPTION OF THE INVENTION

1. Definitions

In this specification and the claims that follow, the word "convex" shall mean a continuously curved surface over a particular region whose tangent varies by at least five (5) degrees. The curve may have uniform angle of radius or it may comprise a substantially continuous curve having a different radius of curvature at different points, as in the preferred embodiment. The convex curve shall be in the vertical dimension of the foot when the man is in the upright position, with the horizontal dimension being substantially linear at all points within the particular region being defined. Such a convex configuration shall constitute a "convex profile," or a "convex region" or "convex portion" of the foot.

In this specification and the claims that follow, the phrase "curved portion" shall mean a convex-shaped portion having a curve whose angle changes by more than a substantially straight plane over the operative range of the foot. Unlike in a "convex portion," the tangent of the "curved portion" need not vary by at least five (5) degrees, but varies more than a substantially straight plane. It may also vary by more than five (5) degrees.

A "curved portion" need not be continuously curved, and it may have a constant radius of curvature or a non-constant radius of curvature over the operative range. Also, a "curved portion" need not be parallel to the vertical dimension or axis when the foosball man is in the vertical position, such as in the preferred embodiment shown below.

In this specification and the claims that follow, the phrase "textured surface" shall mean a surface that has relatively small raised portions surrounded by valleys or groves. These grooves need not be linear, or orderly. The raised portions shall be of uniform height in the direction orthogonal to the surface beneath, thereby retaining the same curvature of the surface beneath, albeit with a slightly larger radius of curvature at any given point to account for the extension. One example of a "textured surface" is often described as a pebbled surface. A second example is parallel ridges. A third example is a crisscross pattern of grooves.

2. Preferred Embodiment

The drawings are for illustrative purposes of the preferred embodiment of the present invention, and are not intended to limit the claims that follow. In particular, the operative part of the present invention is not to scale to better illustrate the difference between the center region of the foot having the convex curvature, and the outer regions adjacent to the convex portion that are substantially straight.

Figure 1:
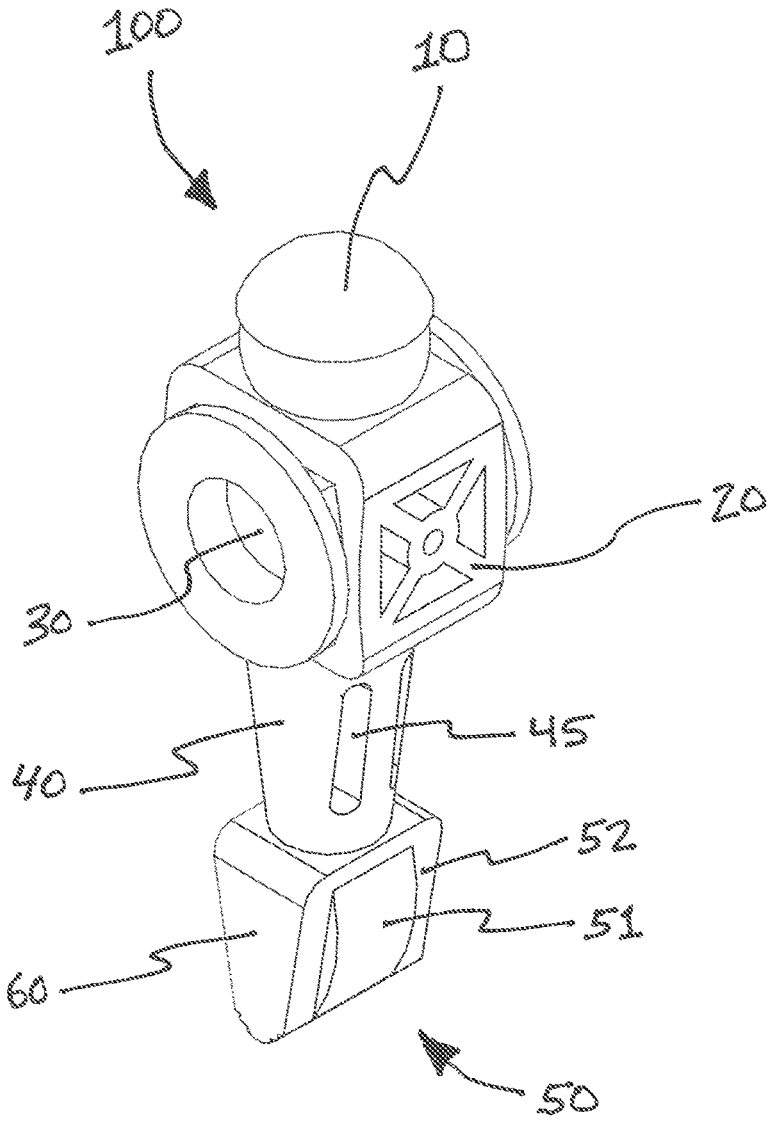
FIG. 1 shows a 3-dimensional view of the foosball man and foot of the preferred embodiment of the present invention.
Figure 2:
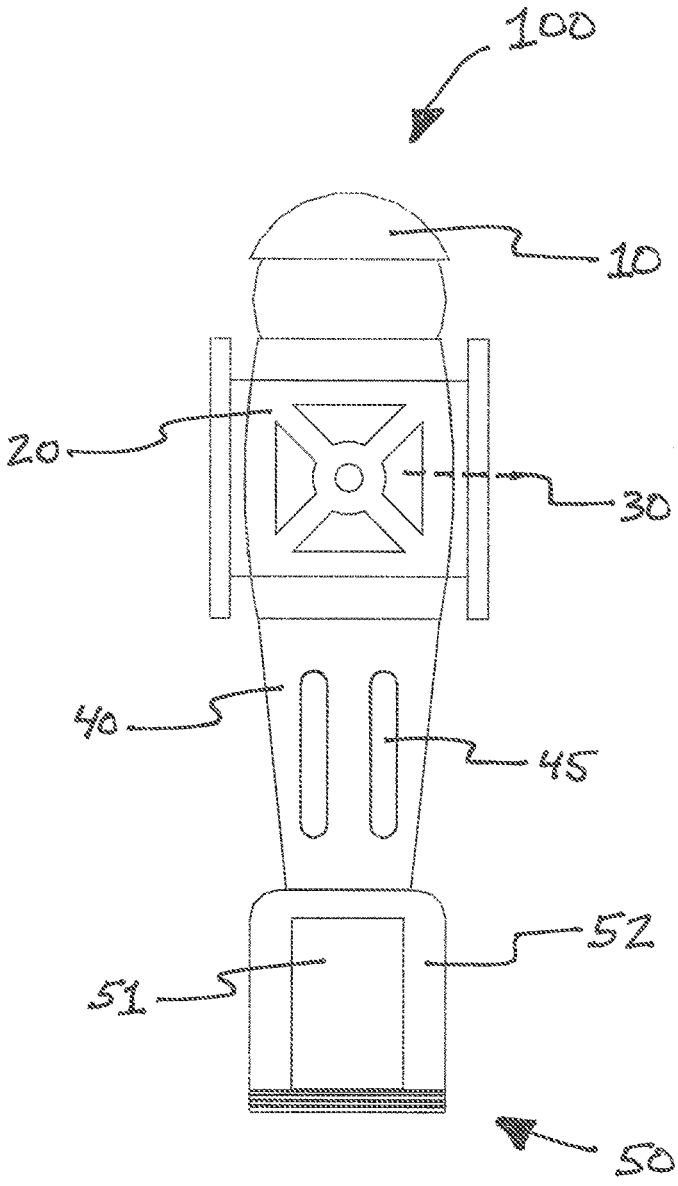
FIG. 2 shows a 2-dimensional front view of the foosball man and foot of the embodiment shown in FIG. 1.
Figure 3:
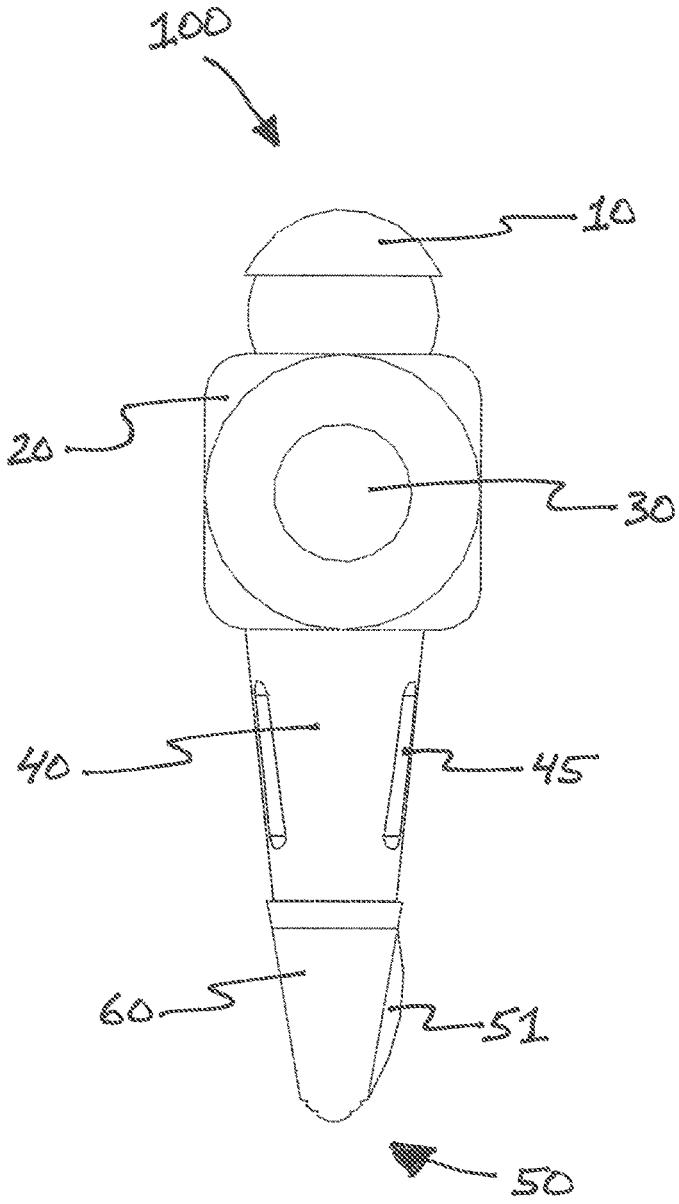
FIG. 3 shows a 2-dimensional side view of the foosball man and foot of the embodiment shown in FIG. 1.
Figure 4:
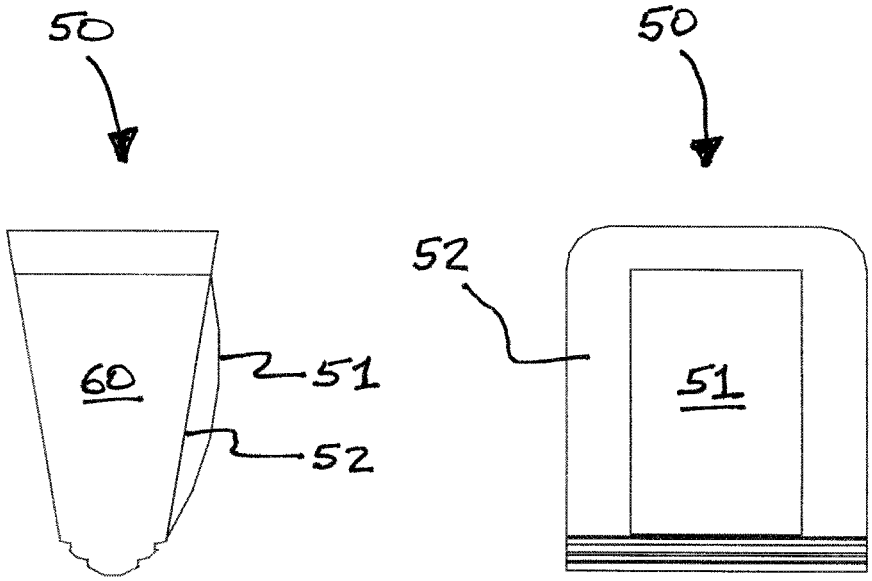
FIG. 4 shows 2-dimensional front- and side-view enlargements of the foot portion of the foosball man shown in FIG. 1.

As shown in FIGS. 1-3, the physical structure of foosball man 100 comprises head 10, torso 20 through which orifice 30 extends to enable a rod (not shown) to pass through orifice 30. The rod is rigidly attached to torso 20 along its interior, which is the exterior surface of orifice 30—a feature well known in the art. Foosball man 100 pivots around the circumference of this rod. Below torso 20 are legs 40, to which foot 50 is attached. Sides 60 of foot 50 are orthogonal to the forward surface of foot 50 (and orthogonal to the longitudinal axis of the rod), enabling lateral passing of ball 200.

In the preferred embodiment of the present invention the mass of the portion of foosball man 100 above the center axis of orifice 30 (the side head 10 is on) is equal to the mass of the portion of foosball man 100 below the center axis of orifice 30, leaving a balanced foosball man 100 where the mass is evenly distributed along the longitudinal axis of the rod around which foosball man 100 rotates. This balance enables a smooth, vibration-free rotation of foosball man 100 along the longitudinal axis of the rod. A weight is molded into head 10 to achieve this mass balance.

Hollow portions 45 of foosball man 100 that extend into legs 40 improve consistency and accuracy of the desired shape when foosball man 100 comes out of a mold. The hollow portions also serve to lighten the lower portion of foosball man 100. The size and mass of head 10 may thus be smaller and lighter to yield the desired balance of foosball man 100, which results in a lighter foosball man 100 that is easier to move laterally.

Figure 5:
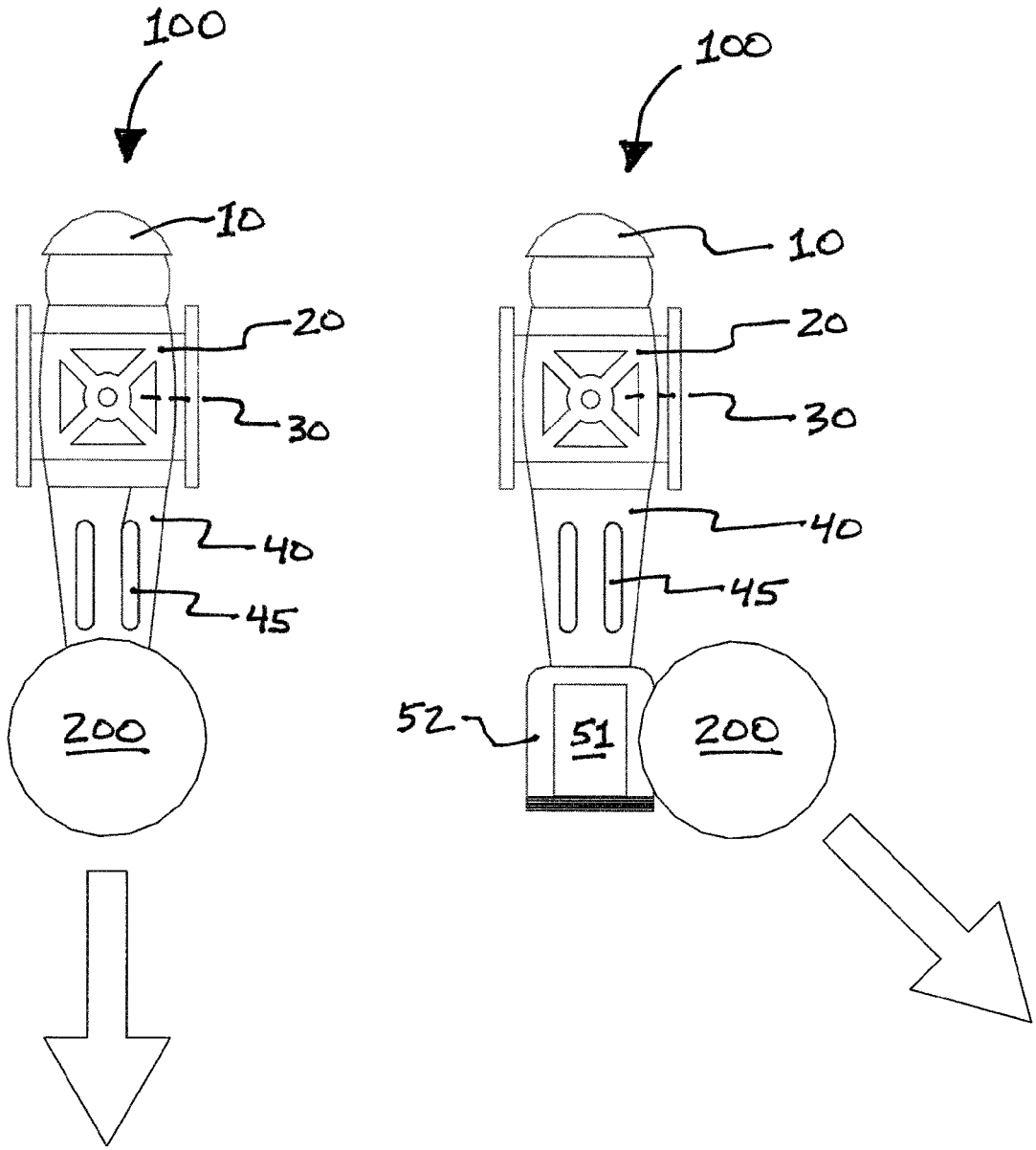
FIG. 5 shows two 2-dimensional front views of the foosball man and foot coming in contact with a ball at the center and outer portions of the foot for hitting a straight and an angled shot, respectively.

The heart of the invention is the profile of the front surface of foot 50, which is shown in FIGS. 1-4. Within the range of contact between ball 200 and foot 50, that is, the operative range, center region 51 has a convex profile in the vertical dimension or axis relative to an upright foosball man 100, and outer regions 52 have a substantially straight region that is angled relative to the vertical dimension or axis. The reason for this difference is to enable the player to more readily trap and control ball 200, and shoot straight, using the convex profile in center region 51 of foot 50, while enabling more accurate angled and bank shots using the substantially straight outer region 52, or edge of foot 50, as shown in FIG. 5.

In the preferred embodiment, both the convex profile (center region 51) and the substantially straight edge profile (outer regions 52) have textured surfaces. The advantage of textured surfaces is in controlling ball 200 by presenting resistance to release. A smooth surface provides for less control but for a quick immediate release.

A constant radius of curvature may be used for the convex profile of the center region 51 of foot 50 in the operative range. In the preferred embodiment, a non-uniform radius of curvature is used. The convex portion need not extend across the entire operative range of the foot in the vertical axis (the axis perpendicular to the longitudinal axis of the rod).

Figure 6:
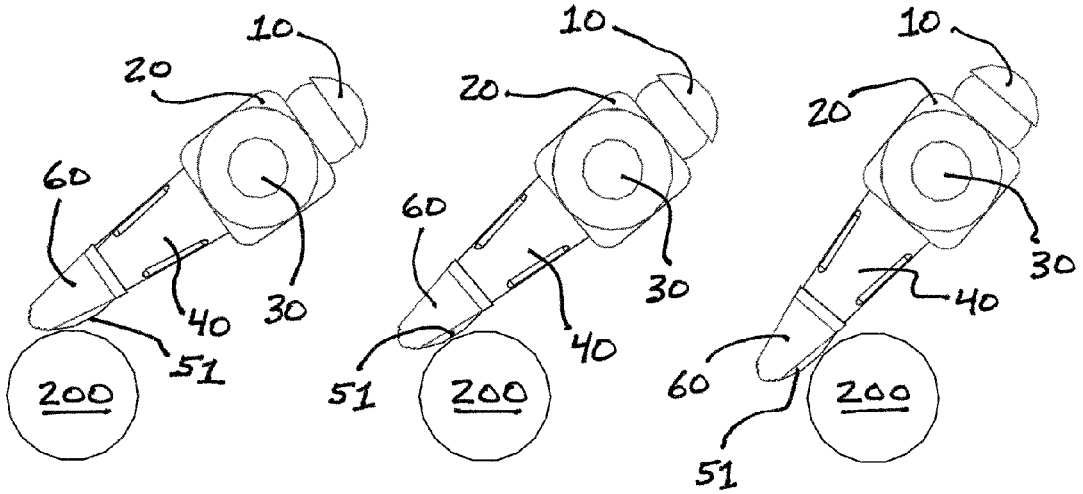
FIG. 6 shows a 2-dimensional side view of three rotational angles (or force vectors) in which the convex portion of the foot in FIG. 1 comes in contact with the ball when trapping and controlling the ball.
Figure 7:
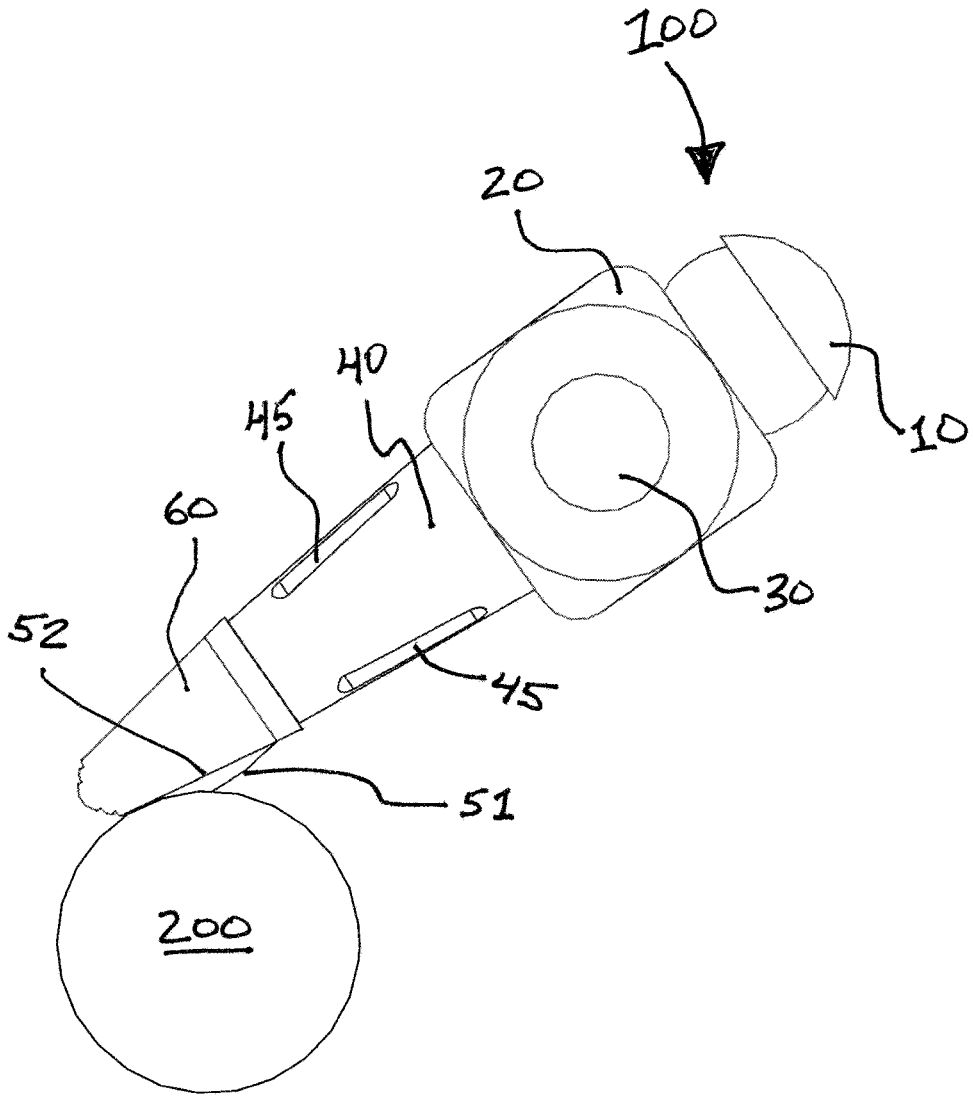
FIG. 7 shows a 2-dimensional side view of the rotational angle (or force vector) in which the straight edge portion of the foot in FIG. 1 comes in contact with the ball when trapping and controlling the ball.

Regardless of the particular convex curvature used for center region 51, the convex profile (center region 51) provides a greater area of contact between foot 50 and ball 200 compared to a straight surface, or plane configuration. This feature is shown in FIG. 6, in which three rotational angles of foot 50 are shown in which ball 200 is controlled and held in place by center region 51. In comparison, there is only one point of contact for trapping and controlling the ball for the flat surface (outer regions 52), as shown in FIG. 7.

As the angle from the point of contact between foot 50 and ball 200 to the point of contact between ball 200 and the playfield more closely approaches 90 degrees, the greater the control and ease in which the player may trap ball 200 and control it. The convex profile also provides a greater range of angles that the player may control 200 with foot 50.

To provide an improved grip of ball 200 by foot 50, center region 51 and outer regions 52 preferably have a textured surface. This feature is standard in the art, and any known method may be employed. The preferred embodiment uses a grooved system in which a series of parallel grooves extend across the operative area of center region 51 and outer regions 52. Alternately, either or both of center region 51 and outer regions 52 may have smooth surfaces.

The mechanics of hitting an angled or bank shot are entirely different from trapping, controlling and shooting ball 200 straight. An angled shot (shown in FIG. 5) is far more difficult to control than a straight shot in part because there must be great precision in the position along the edge of outer portion 52 that strikes ball 200 because there is only one point of contact between outer portion 52 and ball 200, as shown in FIG. 7. Regardless of whether a convex or straight edge is used, there is very little room to be off the desired lateral angle in controlling the angle that ball 200 is propelled off foot 50 because a small change in relative lateral positioning of ball 200 relative to the edge of foot 50 substantially changes the angle of projection of ball 200. In addition, a convex profile such as in center region 51 has the added problem of presenting substantially different rotational angles between ball 200 and the edge of foot 50. The result is that for a slight change in the point at which foot 50 makes contact with ball 200 along the rotational position of foosball man 100 results in a different axis of contact. This presents a marked lack of control as the contact angle significantly changes the trajectory of ball 200 because it is very difficult to accurately hit a spherical ball with a convex surface compared to hitting it with a straight edge. Thus a convex surface provides less accuracy and consistency not only in the lateral position of foot 50 relative to ball 200, but also in the relative rotational position of foot 50 to ball 200 when angled shots are initiated.

The substantially straight plane, however, provides greater accuracy where outer portion 52 of foot 50 hits ball 200 along the rotational dimension as shown in FIG. 5. The change of the angle between outer portion 52 and ball 200 is constant, whereas the change of the angle between a convex profile would vary somewhat unpredictably, thus reducing control.

Figure 8:
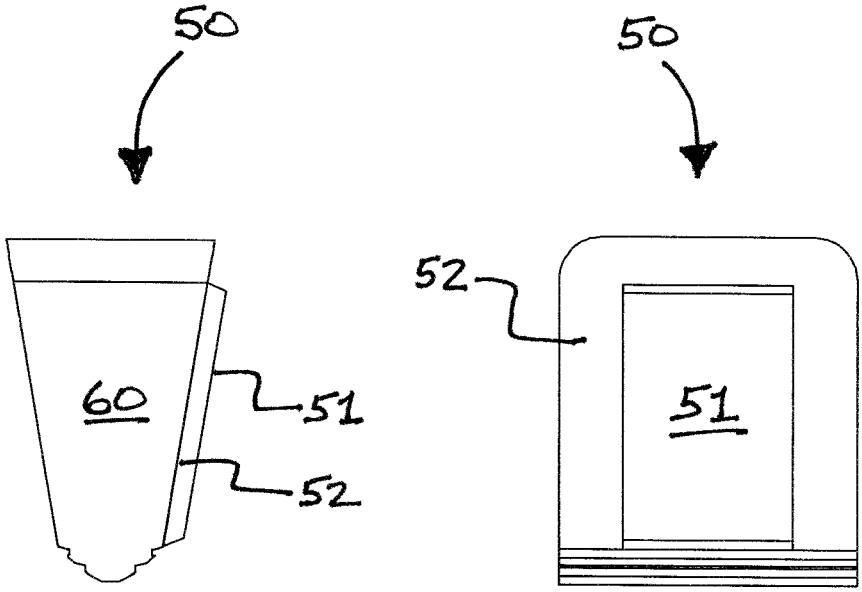
FIG. 8 shows an alternate embodiment of the foot portion of the foosball man in which two different parallel planes are used for the center and outer regions of the foot.

FIG. 8 shows alternate embodiments in which center region 51 has a substantially straight plane instead of a convex profile. As shown in the drawing, the plane defined by center region 51 is parallel the plane defined by outer regions 52. The two planes need not be parallel, but may be angled relative to each other. These surfaces are preferably textured, but may be smooth.

Various other modifications may be made to that depicted in the various drawings of the preferred embodiment of the present invention without departing from the spirit and scope of the invention. Accordingly, the invention is not to be limited by the preferred embodiment shown in the various drawings and described herein, but by the scope of the claims.

The invention claimed is:

1. A foot for a foosball man comprising:

a foosball man having a longitudinal axis and a foot at one end of the longitudinal axis; and a rotating axis perpendicular to the longitudinal axis, around which the foosball man rotates;

wherein the foot has a front surface that is parallel to the rotating axis in the dimension of the rotating axis; a rear surface opposite the front surface and that is parallel to the rotating axis in the dimension of the rotating axis; a left surface that connects the front surface to the rear surface; and a right surface opposite the left surface that connects the front surface to the rear surface;

wherein the front surface has a convex profile in a center region of the front surface that extends across the center region in the dimension of the rotating axis such that the convex profile has a curvature in a dimension that is perpendicular to the rotating axis; a substantially flat portion on a left outer region of the front surface positioned between the center region and the left surface in the dimension of the rotating axis, and a substantially flat portion of a right outer region of the front surface positioned between the center region and the right surface, where the planes defined by the left and right outer regions are parallel to the rotating axis in the dimension of the rotating axis; and wherein the front surface has a first width in the dimension of the rotating axis, the center region has a second width in the dimension of the rotating axis and that is less than the first width, the left outer region has a third width in the dimension of the rotating axis and is positioned between the center region and the left surface, and the right outer region has a fourth width in the dimension of the rotating axis and that is positioned between the center region and the right surface;

such that when the longitudinal axis of the foosball man is perpendicular to a playfield that is parallel to the rotating axis, a foosball ball may be struck by the foot at the center region along the second width, at the left outer region along the third width, or at the right outer region along the fourth width when hitting a forward shot towards the goal.

2. The foot for a foosball man of claim 1 in which the third and fourth widths are each at least 0.0875 inch.

3. The foot for a foosball man of claim 1 in which the each of the third and fourth widths are not more than 0.25 inch.

4. The foot for a foosball man of claim 1 in which the second width is at least 0.4 inch.

5. The foot for a foosball man of claim 1 in which the convex profile has a constant radius of curvature.

6. The foot for a foosball man of claim 1 in which the convex profile has a non-constant radius of curvature.

7. A foot for a foosball man comprising:

a foosball man having a longitudinal axis having a foot at one end of the longitudinal axis; and a rotating axis perpendicular to the longitudinal axis, around which the foosball man rotates;

wherein the foot has a front surface that is parallel to the rotating axis in the dimension of the rotating axis, a rear surface opposite the front surface and that is parallel to the rotating axis in the dimension of the rotating axis, a left surface that connects the front surface to the rear surface, and a right surface opposite the left surface that connects the front surface to the rear surface;

wherein the front surface has a center region in the center of the front surface along the dimension of the rotating axis, a left outer region that is positioned between the center region and the left surface in the dimension of the rotating axis, and a right outer region that is positioned between the center region and the right outer region in the dimension that of the rotating axis; and wherein the center region has a first curved region extending across the center region in the dimension of the rotating axis and having a first average radius of curvature, where the curvature of the first curved region in the longitudinal dimension is perpendicular to the rotating axis, and each of the left and right outer regions have a second curved region in the longitudinal dimension with a second average radius of curvature, where the curvature of each of the second curved regions in the longitudinal dimension is perpendicular to the rotating axis, and where the second average radius of curvature differs from the first average radius of curvature;

wherein the front surface has a first width in the dimension of the rotating axis, the center region has a second width in the dimension of the rotating axis and that is less than the first width, the left outer region has a third width in the dimension of the rotating axis and is positioned between the center region and the left surface, and the right outer region has a fourth width in the dimension of the rotating axis and that is positioned between the center region and the right surface;

such that when the longitudinal axis of the foosball man is perpendicular to a playfield that is parallel to the rotating axis, a foosball ball may be struck by the foot at the center region along the second width, at the left outer region along the third width, or at the right outer region along the fourth width when hitting a forward shot towards the goal.

8. The foot for a foosball man of claim 7 in which the third and fourth widths are at least 0.0875 inch.

9. The foot for a foosball man of claim 7 in which the third and fourth widths are each not more than 0.25 inch.

10. The foot for a foosball man of claim 7 in which the second width is at least 0.4 inch.

11. The foot for a foosball man of claim 7 in which the first curved region has a constant radius of curvature.

12. The foot for a foosball man of claim 7 in which the first curved region has a non-constant radius of curvature.

13. A foot for a foosball man comprising:

a foosball man having a longitudinal axis with a foot on one end of the longitudinal axis; and a rotating axis perpendicular to the longitudinal axis, around which the foosball man rotates;

wherein the foot has a front surface that is parallel to the rotating axis in the dimension of the rotating axis, a rear surface opposite the front surface and that is parallel to the rotating axis in the dimension of the rotating axis, a left surface connecting the front and rear surfaces, and a right surface opposite the left surface connecting the front and rear surfaces;

wherein the front surface has a center region defining a first plane that is parallel to the rotating axis in the dimension of the rotating axis, a left outer region positioned between the center region and the left surface, and a right outer region positioned opposite the left outer region and between the center region and the left surface, both of which define a second plane that is parallel to the rotating axis in the dimension of the rotating axis, where the first and second planes are different planes;

such that when the longitudinal axis of the foosball man is perpendicular to a playfield that is parallel to the rotating axis, a foosball ball may be struck by the foot at the center region, at the left outer region, or at the right outer region when hitting a forward shot towards the goal.

14. The foot for a foosball man of claim 13 in which the first plane is angled differently relative to the centerline axis from the second plane.

15. The foot for a foosball man of claim 13 in which the first plane is parallel to the second plane.

16. The foot for a foosball man of claim 13 in which a width in the dimension parallel to the rotating axis of the center region is greater than the sum of a width of each of the left and right outer regions in the dimension parallel to the rotating axis.

17. The foot for a foosball man of claim 16 in which a width in the dimension parallel to the rotating axis of each of the left and right outer regions is at least 0.0875 inch.

18. The foot for a foosball man of claim 16 in which a width in the dimension parallel to the rotating axis of the each of the left and right outer regions is not more than 0.25 inch.

19. The foot for a foosball man of claim 16 in which a width in the dimension parallel to the rotating axis of the center region is at least 0.4 inch.

* * * * *